United States Patent [19]

Mechesney

[11] Patent Number: 4,962,951

[45] Date of Patent: Oct. 16, 1990

[54] BOOK COVER AND NOTE KEEPER SYSTEM

[76] Inventor: Veronica A. Mechesney, 1860 Jancey St., Pittsburgh, Pa. 15206

[21] Appl. No.: 488,529

[22] Filed: Feb. 28, 1990

Related U.S. Application Data

[63] Continuation of Ser. No. 184,182, Apr. 21, 1988, abandoned.

[51] Int. Cl.[5] ..... B42D 15/00; B42D 3/00; B42D 3/04; B42F 21/00

[52] U.S. Cl. ..... 283/114; 283/42; 281/31; 281/34

[58] Field of Search ..... 283/114, 42; 281/31, 281/34

[56] References Cited

U.S. PATENT DOCUMENTS

| | | | |
|---|---|---|---|
| D. 182,366 | 3/1958 | Jonas | D59/2 |
| D. 186,559 | 11/1959 | Talley | D74/2 |
| D. 202,940 | 11/1965 | Bloom | D59/2 |
| D. 215,535 | 9/1969 | Tucker | D97/2 |
| D. 231,714 | 5/1974 | Arthur | D74/2 B |
| D. 236,857 | 9/1975 | Lookatch | D87/3 A |
| D. 267,152 | 12/1982 | Nerlinger | D19/3 |
| D. 267,653 | 1/1983 | Miller et al. | D19/26 |
| 1,305,939 | 6/1919 | Schmidt . | |
| 1,336,584 | 4/1920 | Ringer . | |
| 1,560,058 | 11/1925 | Jamieson . | |
| 1,674,222 | 6/1928 | Quigley . | |
| 1,743,191 | 1/1930 | Charlton . | |
| 2,052,623 | 1/1936 | Harby | 93/1 |
| 2,878,814 | 3/1959 | Consaul | 129/16.8 |
| 3,071,819 | 1/1963 | Harrison | 281/34 |
| 3,742,634 | 7/1973 | Van Hafften | 40/359 |
| 3,805,426 | 4/1974 | Cunningham | 40/2 R |
| 3,857,587 | 12/1974 | Friedman | 283/42 |
| 3,877,729 | 4/1975 | Friedman | 283/42 |
| 3,937,493 | 2/1976 | Fasbender | 283/41 |
| 3,962,807 | 6/1976 | Pantone | 40/78.15 |
| 4,143,477 | 3/1979 | Reynolds | 40/359 |
| 4,175,777 | 11/1979 | Horn | 283/42 |
| 4,201,403 | 5/1980 | Turner | 283/21 |
| 4,204,639 | 5/1980 | Barber et al. | 235/462 |
| 4,301,962 | 11/1981 | Monckton et al. | 281/31 |
| 4,334,771 | 6/1982 | Ryan, Jr. | 283/114 |
| 4,451,067 | 5/1984 | Williams | 281/31 |
| 4,614,509 | 9/1986 | Neiman | 281/31 |
| 4,629,349 | 12/1986 | Pitts | 281/31 |

*Primary Examiner*—Douglas D. Watts
*Assistant Examiner*—Paul M. Heyrana Sr.
*Attorney, Agent, or Firm*—Lawrence G. Zurawsky; Thomas F. Shanahan

[57] ABSTRACT

A system for correlating one or more books with other related information comprises at least one book cover having preaffixed or preprinted on its front or outer surface prominent indicia of the subject matter of the book, and, companion storage means, such as note books, file folders or other storage means, having the same prominent indicia preprinted or preaffixed on its front or outer surface so that subject identification and the correlation of the several elements is readily perceived.

22 Claims, 1 Drawing Sheet

BOOK COVER AND NOTE KEEPER SYSTEM

This is a continuation of copending application(s) Ser. No. 07/184,182 filed on Apr. 21, 1988 abandoned 2/28/89.

BACKGROUND OF THE INVENTION

1. Field of the Invention

This invention relates generally to organizing and systematizing a plurality of units of intelligence which include one or more books, manuals, treatises or the like, relating to a given subject matter, and, companion information receiving and storage means, such as note books, file folders, portfolios or similar such information storage means designed for collecting and retaining a plurality of items of related subject matter. More particularly, the invention relates to categorizing and correlating or coordinating notes, reports, work sheets, tests or other forms of intelligence, that relate to, and are useful in connection with, a given subject matter and that generally comprise complimentary, supplementary or ancillary forms of information, with one or more printed volumes of text that encompass the main, principal or broad subject matter of the information or intelligence being organized or systematized.

2. Description of the Prior Art

The prior art, as relates to the present invention, appears to be devoid of any systems specifically dedicated to correlating, identifying or directly associating a text, text book or the like with related handwritten or printed notes or memoranda, such as a researcher or student would normally accumulate in conjunction with a specific subject or course of study or investigation. Anyone, inadvertently finding himself in possession of the wrong book or notes because the unwanted material in hand looked like other material left elsewhere, can attest to the need for a system to better identify and correlate related text and note materials.

A search in the marketplace for such a system has been without avail. One can find notebooks, folders, binders and like note keepers in a variety of similar or companion colors, such that related notekeeping by subject, project or other such criteria can generally be facilitated by color association. However, there still remains the problem of relating such work materials to a text or several texts that comprise the basic research, teaching or learning materials to which the work materials relate.

A search of prior U.S. patents revealed no coordinating system; just a variety of labels, tabs, signals, specialized file folders and the like that frequently employ special color indicia or other annunciator means as an aid to filing or information retrieval. These patents include: U.S. Pat. Nos. 1,674,222; 2,878,814; 3,805,426; 3,962,807; 4,201,403; 1,305,939; 3,937,493; 4,143,477; 4,175,777; 4,204,639; 1,336,584; 1,560,058; 1,743,191; 2,052,623; 3,742,634; and U.S. Design Patent Nos. 182,366; 202,940; 231,714; 186,559; 215,535; 236,857; 267,152; 267,653. Thus, it will be appreciated that there remains a need for a book and note keeper system in which the identification and correlation of the several elements of related subject matter are easily and readily perceived.

SUMMARY OF THE INVENTION

In accordance with the present invention, a bookcover and note keeper system is provided for correlating one or more books or the like with other related information. In particular, the novel system of the invention comprises at least one book cover having preaffixed or preprinted on its outer surface prominent indicia of the subject matter of the book, and, companion storage means, such as note books, file folders or other storage means, having the same prominent indicia preprinted or preaffixed on its outer surface, so that subject identification and the correlation of the several elements are readily, perceived.

DESCRIPTION OF THE PREFERRED EMBODIMENTS

Figure 1:
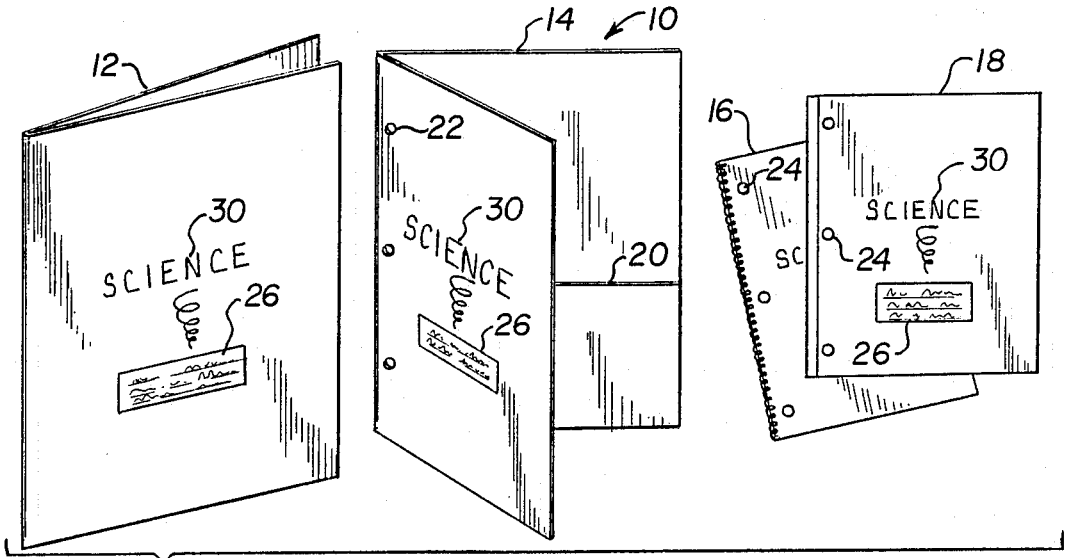
FIG. 1 is a perspective illustrating several elements of a set or kit of materials that comprise one embodiment of the present invention and, as shown from left to right, includes a book cover, a portfolio or folder and a plurality of theme or note books, one of which is spiral bound.

Referring to the drawing and, in particular, to FIG. 1, there is shown a typical kit or set of elements comprising one illustrative embodiment of the novel book cover and note keeper system 10 of this invention. Book cover and note keeper system or kit 10, shown, includes a sheet of protective book covering 12, a portfolio or folder 14, a spiral bound note book 16 and an adhesively edge-bound theme book or note book 18, each carrying common subject matter indicia on its outer surface. It will be understood, however, that the particular combination of elements 12, 14, 16 and 18, as shown, is illustrative of only one embodiment of the present invention. It is within the contemplation of this invention that any combination of one or more book covers, such as protective book cover 12, and one or more note keepers, such as portfolio 14, note books 16 or 18, or other similar or dissimilar and, generally, text-free or substantially text-free information receiving and storage means, each having an outer surface that is identical or substantially identical in appearance and/or structure, may comprise a novel book cover and note keeper system 10, in accordance with this invention.

Protective book cover 12, as illustrated, preferably comprises a sheet of protective covering material having length and width dimensions sufficient to be cut to size to form a jacket or to permit conventional longitudinal and transverse folding of the material to produce transverse edge pockets into which the fastened or bound covers of a wide variety of different size books can be inserted. It has been determined, for example, that a sheet of protective covering 12, having typical dimensions of about fifteen (15) inches wide by twenty-two (22) inches long is satisfactory to provide a book cover for a large majority of the different book sizes that are produced. The composition of the material for protective book cover 12, moreover, can be that of any of the conventional materials used for the purpose of covering books, including cellulosic materials, organic plastic materials, plastic impregnated or coated materials, etc., or other materials of whatever nature found to be most desirable for the purpose.

The portfolio or folder 14 and the note books 16 and 18, shown, are of any suitable dimensions and general physical construction. The particular portfolio or folder 14, shown, typically has overall dimensions of about nine (9) inches by twelve (12) inches and is of the duo or double interior pocket variety, one such pocket 20 being indicated in the drawing. Also indicated are ring binder holes or apertures 22 which may be provided for conventional use in security portfolio 14 in a ring binder. Similarly, spiral bound note book 16 and adhesively edge-bound theme book 18 may, for example, have conventional overall dimensions of about eight (8) inches by ten and one-half (10½) inches or eight and one-half (8½) inches by eleven (11) inches and may also include in their construction, if desired, ring binder holes 24 for securing such note books in a ring binder.

The color, graphics, structure and composition of materials used for the construction of portfolio or folder 14 and the covers of note books 16 and 18 is, most desirably, the same as that chosen for protective book cover 12 or, at least, the material used is very similar in composition, structure and/or visual appearance to the materials used for the book covering 12. In addition to the desirability of identity of composition, structure and/or visual appearance, it will be apparent that the material chosen for protective cover 12 must be susceptible of being cut, folded or creased in some manner to permit forming a book cover or book jacket for a book. Moreover, it is preferred that, if the material chosen be of a nature that will not readily accept being written on, an area be provided on an exposed surface of the book cover and note keeper or note keepers, by any suitable device or means, for the purpose of recording specialized information, such as the name of the owner of the book. Such an area is indicated at 26 in the several figures of drawing pertaining to this invention.

The invention herein is particularly characterized by the identity or substantial identity in appearance and/or structure of the several related or associated elements of the novel combination. Generally, structure is of secondary import compared to appearance, unless a person is unsighted and needs to rely on Braille or other structure carried on a surface of the articles for the purpose of subject identification or the like. In any event, color, graphics and/or structure, alone or in combination, are the criteria chosen, for the purpose of this invention, so that identification and correlation of several elements, i.e, books and note keepers, of related subject matter are easily and readily perceived. Moreover, the term color, as used herein, is intended to include anything perceived as color and, in particular, both chromatic and achromatic colors throughout their entire range or spectra, as well as combinations of such colors. The term graphics, of course, is intended to include designs, words or letters, numbers, symbols, patters of colors, etc., and, in general, anything capable of representation as a painting, drawing, writing, or inscription. Representative graphics is shown at 30 by the word "SCIENCE" above a tornado 'wind vortex' design. Structure, on the other hand, is generally limited to the surface finish of the material or materials used and, while it may be deemed to be inclusive of particular graphics, such as Braille writing, it has more general reference to such matters as, for example, smooth, rough or pebble grain finishes.

Figure 2:
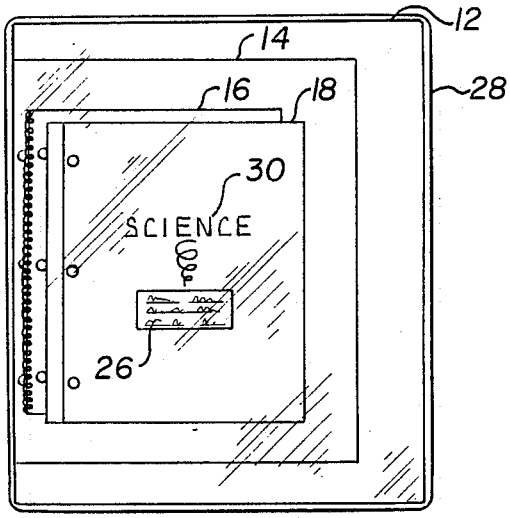
FIG. 2 is a plan view of a package or kit containing the several elements of the novel combination of FIG. 1.

With reference to FIG. 2 and using the reference numerals from FIG. 1, a package or kit is shown containing all of the elements of the novel combination of FIG. 1. The additional item illustrated in FIG. 2, of course, is the packaging material 28, which generally will be a commercially available, transparent, plastic film, but can also be any suitable, preferably partially transparent material.

Figure 3:
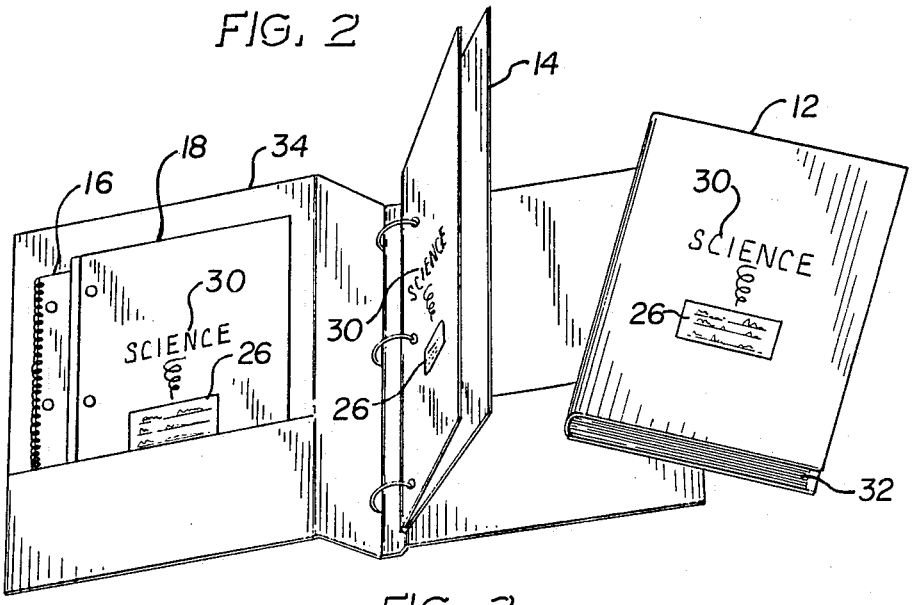
FIG. 3 is a perspective of the several elements of the novel combination of FIG. 1 as they might appear in use and illustrating a book covered by the book cover of FIG. 1, and, the folder or portfolio and note books of FIG. 1 carried in a ring binder that could comprise an additional element of the novel combination of this invention.

FIG. 3, again, uses the references numerals from FIG. 1 and illustrates one form in which a typical kit 10 may be used. As shown, in addition to correlating a book 32 with related notes carried in portfolio or folder 14 and note books 16 and 18, the related notes themselves are consolidated in a ring binder 34. Although not specifically illustrated, it will be understood that the outer cover of ring binder 34 may carry the same indicia, if desired, as that carried by the protective book cover 12, portfolio 14 and note books 16 and 18, such that further correlation of the related note keepers with each other is facilitated.

According to the provisions of the patent statutes, I have explained the principle, preferred construction and mode of operation of my invention and have illustrated and described what I now consider to represent the best embodiment. However, it should be understood that, within the scope of the appended claims, the invention may be practiced otherwise than as specifically illustrated and described.

I claim:

1. A set of materials for correlating information relating to a common subject matter, said set of materials including at least one book cover and at least one note keeper, and wherein said book cover and said note keeper each having a common subject matter indicia on its outer surface such that a book covered by the book cover and related materials collected and retained in the note keeper can be directly correlated with each other by said common subject matter indicia, said set of materials comprising, a sheet of protective book covering material for covering the bound covers of a printed book, said sheet of book covering material, in use, being affixed to and enclosing said bound covers of said book and having preaffixed on its outer surface prominent indicia of the subject matter of said book, said indicia by reason of graphics, color, or structure, separately or in combination, being susceptible of easy perception and subject identification, and a companion note keeper comprising information receiving and storage means for use with said book for collecting and retaining information relating to the subject matter of said book, said information receiving and storage means being essentially free of text and having preaffixed on its outer surface essentially the same indicia of said subject matter of said book as that carried on the outer surface of said book covering material.

2. A set of materials as in claim 1 in which said information receiving and storage means includes a note book.

3. A set of materials as in claim 2 which also includes a portfolio type folder.

4. A set of materials as in claim 3 which further includes an additional sheet of protective book covering material for covering the bound covers of a second printed book related in subject matter to that of said first mentioned book, said additional sheet of protective book covering material, in use, being affixed to and enclosing said bound covers of said second book and also having preaffixed on its outer surface essentially the same prominent indicia of subject matter as the subject matter indicia for the protective covering of said first mentioned book and for the outer surface of said companion note keeper, said indicia by reason of graphics, colors, or structure, separately or in combination, being susceptible of easy perception and subject identification.

5. A set of materials as in claim 4 in which said subject matter indicia comprises color.

6. A set of materials as in claim 4 in which said subject matter indicia comprises graphics.

7. A set of materials as in claim 4 in which said subject matter indicia comprises color and graphics.

8. A set of materials is in claim 4 in which said subject matter indicia comprises structure.

9. A set of materials as in claim 3 in which said subject matter indicia comprises color.

10. A set of materials as in claim 3 in which said subject matter indicia comprises graphics.

11. A set of materials as in claim 3 in which said subject matter indicia comprises color and graphics.

12. A set of materials as in claim 3 in which said subject matter indicia comprises structures.

13. A set of materials as in claim 1 in which said information receiving and storage means includes a portfolio type folder.

14. A set of materials as in claim 1 in which said information receiving and storage means includes a file folder.

15. A set of materials as in claim 1 in which said information receiving and storage means includes a ring binder.

16. A set of materials as in claim 1 which includes an additional sheet of protective book covering material for covering the bound covers of a second printed book related in subject matter to that of said first mentioned book, said additional sheet of protective book covering material, in use, being affixed to and enclosing said bound covers of said second book and also having preaffixed on its outer surface essentially the same prominent indicia of subject matter as the subject matter indicia for the protective covering of said first mentioned book and for the outer surface of said companion note keeper, said indicia by reason of graphics, color, or structure, separately or in combination, being susceptible of easy perception and subject identification.

17. A set of materials as in claim 1 in which said subject matter indicia comprises color.

18. A set of materials as in claim 1 in which said subject matter indicia comprises graphics.

19. A set of materials as in claim 1 in which said subject matter indicia comprises color and graphics.

20. A set of materials as in claim 1 in which said subject matter indicia comprises structure.

21. A set of materials for correlating information relating to a common subject matter, said set of materials including at least one book cover and at least one note keeper, and wherein said book cover and said note keeper each have a common subject matter indicia on its outer surface such that a book covered by the book cover and related materials collected and retained in the note keeper can be directly correlated with each other by said common subject matter indicia, said set of materials comprising, a sheet of protective book covering material for covering the bound covers of a printed book, said sheet of book covering material, in use, being affixed to and enclosing said bound covers of said book and having preaffixed on its outer surface prominent indicia of the subject matter of said book, said indicia by reason of graphics, color, or structure, separately or in combination, being susceptible of easy perception and subject identification, and a companion note keeper comprising information receiving and storage means for use with said book for collecting and retaining information relating to the subject matter of said book, said information receiving and storage means having preaffixed on its outer surface essentially the same indicia of said subject matter of said book as that carried on the outer surface of said book covering material.

22. A method for correlating a plurality of units of intelligence relating to a common subject matter, said units of intelligence including at least one printed and bound book and a collection of related notes, memoranda and like material, which comprises, providing a cover for the binding of said printed and bound book, said cover having preaffixed on its outer surface prominent indicia of said common subject matter, said indicia by reason of graphics, color, or structure, separately or in combination, being susceptible of easy perception and subject identification, and providing information receiving and storage means for said related material, said information receiving and storage means having preaffixed on its outer surface essentially the same indicia of said subject matter as that carried on the outer surface of said cover on said printed and bound book, so that, when said related material and said book are to be used together, their respective identification and correlation is readily perceived and easily facilitated.

* * * * *